US006484331B2

(12) United States Patent
Minnick

(10) Patent No.: US 6,484,331 B2
(45) Date of Patent: Nov. 26, 2002

(54) WASTE AND OVERFLOW SYSTEM FOR A BATHTUB

(75) Inventor: Michael W. Minnick, North Ridgeville, OH (US)

(73) Assignee: Oatey Co., Cleveland, OH (US)

( * ) Notice: Subject to any disclaimer, the term of this patent is extended or adjusted under 35 U.S.C. 154(b) by 0 days.

(21) Appl. No.: 09/791,934

(22) Filed: Feb. 22, 2001

(65) Prior Publication Data

US 2002/0112285 A1 Aug. 22, 2002

(51) Int. Cl.[7] ..... E03C 1/244
(52) U.S. Cl. ..... 4/694; 4/679; 285/3
(58) Field of Search ..... 4/680, 679, 683, 4/684, 685, 694; 285/3; 138/90

(56) References Cited

U.S. PATENT DOCUMENTS 1,213,466 A * 1/1917 Delanoy ..... 285/3
3,121,879 A * 2/1964 Young ..... 4/694
4,307,901 A * 12/1981 Orberg et al. ..... 285/3
6,192,531 B1 2/2001 Fritz et al. ..... 4/679
6,289,532 B1 * 9/2001 Fritz et al. ..... 4/679

* cited by examiner

*Primary Examiner*—Robert M. Fetsuga
(74) *Attorney, Agent, or Firm*—Renner, Otto, Boisselle & Sklar, LLP

(57) ABSTRACT

A waste and overflow system for a bathtub includes an overflow conduit having a threaded end and an overflow cap threaded at one end extending through the overflow opening in the bathtub into threaded engagement with the threaded end of the conduit. The other end of the overflow cap has a test cap portion removably connected thereto for closing off an overflow passage through the overflow cap during pressure testing of the system. The test cap portion is removable from the other end of the overflow cap upon completion of the system pressure test to open up the overflow passage through the overflow cap.

21 Claims, 4 Drawing Sheets

WASTE AND OVERFLOW SYSTEM FOR A BATHTUB

FIELD OF THE INVENTION

This invention relates to a waste and overflow system for handling any overflow from a bathtub.

BACKGROUND OF THE INVENTION

A typical waste and overflow system for a bathtub includes a standard overflow elbow that is held in sealed engagement with the back side of the tub in line with the tub overflow opening by self-tapping screws that extend through slots in a mounting bar overlying the overflow opening adjacent the front side of the tub and through the tub overflow opening into holes in a flange portion of the elbow.

When the waste and overflow system is initially installed, the elbow drain opening must be sealed in a fluid tight manner to permit pressure testing of the sanitary drainage system for leaks. Heretofore, this was typically done by inserting a gasketed test cap into the elbow drain opening through the tub overflow opening and threading a screw through a mounting hole in the mounting bar to cause the screw to press tightly against the test cap to hold the test cap in sealing engagement with the overflow elbow. After pressure testing is completed, the screw and test cap are removed and a cover plate is placed over the tub overflow opening and held in place by a mounting screw extending through the cover plate and into threaded engagement with the mounting hole in the mounting bar.

This particular system has the objection that it is time consuming to install both the drain elbow and test cap to insure a fluid tight seal during pressure testing of the system and then remove the test cap and replace it with a cover plate.

SUMMARY OF THE INVENTION

The present invention is for a waste and overflow system for a bathtub that is relatively easy to install and allows for pressure testing of the system without having to install a separate test cap in the drain opening of the drain overflow elbow or other overflow conduit after installation. To that end, the drain overflow conduit is threaded for ease of threadedly connecting a threaded end of an overflow cap to the overflow conduit through the overflow opening in the tub. The overflow cap has an overflow passage that is initially closed by a test cap portion that is removably attached to the outer end of the overflow cap, thereby eliminating the need for having to install a separate test cap into the conduit overflow drain opening before pressure testing of the system.

In one form of the invention, the test cap portion is integrally connected to the outer end of the overflow cap by a frangible seam to facilitate removal of the test cap portion from the overflow cap after the pressure test has been completed.

In another form of the invention, the test cap portion is attached to the outer end of the overflow cap by a leak-proof mechanical connection that permits easy removal of the test cap portion after the pressure test has been completed.

The overflow cap may have a handle protruding therefrom to facilitate threading of the overflow cap into the overflow conduit. Also, a slot may be provided in the handle for insertion of a screwdriver blade or other rod-like tool to facilitate tightening of the overflow cap into the overflow conduit and, in the case of a frangible test cap portion, prying off of the test cap portion after the system pressure test has been completed to provide an overflow outlet in the overflow cap in communication with the overflow conduit.

Upon removal of the test cap portion, a locking ring may be attached to the overflow cap by providing a mechanical locking connection therebetween. In one embodiment of the invention disclosed herein, the mechanical locking connection includes tabs on the overflow cap that are received in slots or recesses in the locking ring. When the locking ring is rotated in a locking direction, each tab rides up respective ramps on the locking ring to lock the locking ring against the overflow cap. The locking ring has a cross bar with a mounting hole therein for securing a cover plate over the locking ring and tub overflow opening using a mounting screw. However, it will be appreciated that other types of mechanical locking connections may be provided including standard type threaded connections between the overflow cap and locking ring as well as between the overflow cap and test cap portion.

To the accomplishment of the foregoing and related ends, the invention, then, comprises the features hereinafter more fully described and particularly pointed out in the claims, the following description and annexed drawings setting forth in detail certain illustrative embodiments of the invention, these being indicative, however, of but several of the various ways in which the principles of the invention may be employed.

DETAILED DESCRIPTION OF THE INVENTION

Figure 1:
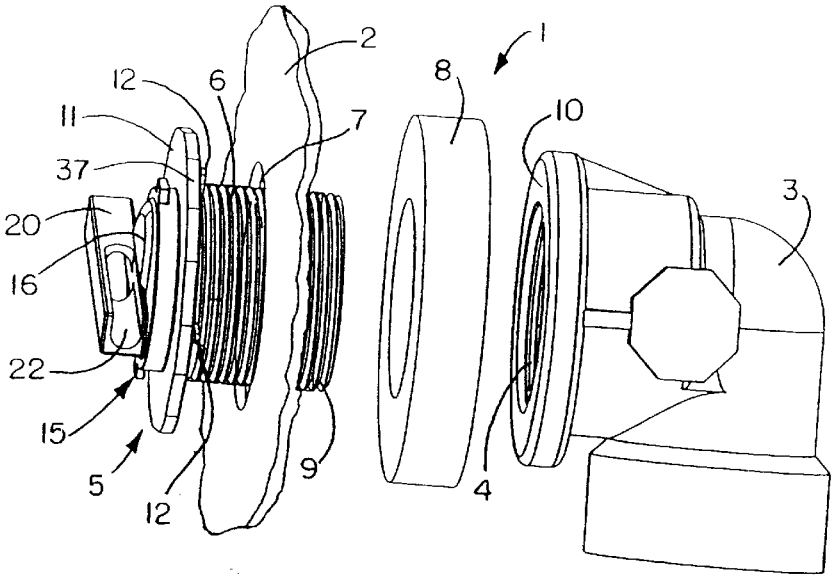
FIG. 1 is an exploded view of one form of waste and overflow system for a bathtub in accordance with the present invention.
Figure 2:
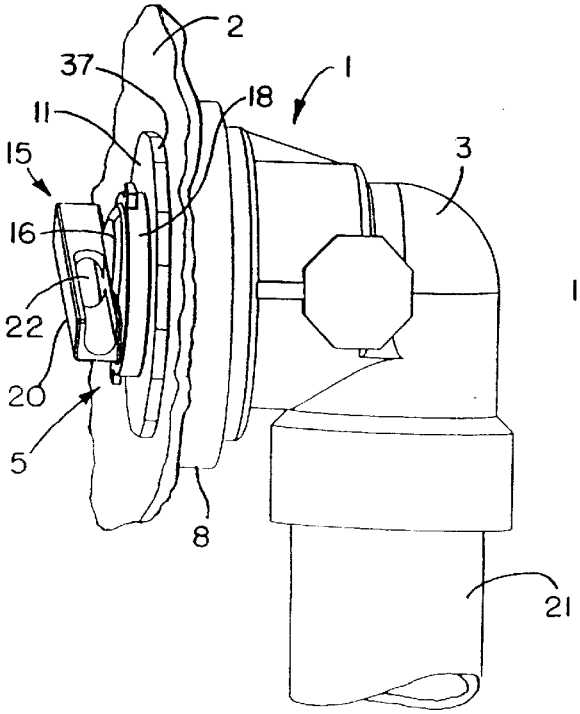
FIG. 2 is a side elevation view showing the waste and overflow system of FIG. 1 in final assembled condition with a drain pipe connected to an overflow elbow.

One form of waste and overflow system 1 for a bathtub 2 according to the present invention is schematically shown in FIGS. 1 and 2. The system 1 includes an overflow elbow or other drain conduit 3 having an internally threaded end portion 4 and an overflow cap 5 having an externally threaded end portion 6 that is designed to be inserted through an overflow opening 7 in the bathtub and threaded into the overflow elbow 3 for securing the overflow elbow 3 against the back side of the tub. Alternatively, the overflow elbow or other conduit could be externally threaded and the end portion of the overflow cap internally threaded if desired. Before threading the overflow cap 5 and overflow elbow 3 together, an overflow gasket 8 is inserted over the threaded end portion 7 of the overflow cap. Also, Teflon tape or pipe joint compound (not shown) should be used on the threads 9 of the overflow cap before screwing the overflow cap into the overflow elbow. As the overflow cap is threaded into the overflow elbow, the gasket 8 is compressed between the flange 10 surrounding the internally threaded end portion 4 of the overflow elbow 3 and the back side of the tub to form a water-tight seal therebetween as schematically shown in FIG. 2.

The overflow cap 5 has a radial flange 11 adjacent the outer end thereof that engages the front wall of the tub during tightening of the overflow cap into the overflow elbow. Circumferentially spaced centering tabs 12 (shown in FIG. 1) may be provided on the back side of the flange 11 to prevent offset installations.

The overflow cap has an overflow passage 14 (see FIG. 4) extending from one end to the other that is initially closed by a test cap portion 16 removably attached to the outer end 15 of the overflow cap. This eliminates the need for having to install a separate test cap into the end portion 4 of the overflow elbow 3 before pressure testing the system.

In the embodiment shown in FIGS. 1–4, the test cap portion 16 is integrally molded to the outer end 15 of the overflow cap by a frangible seam 17 (see FIG. 3) for ease of removal of the test cap portion therefrom after the pressure test has been completed. Surrounding the test cap portion 16 is a cylindrical rim 18. The test cap portion 16 is integrally molded to the inner periphery of the cylindrical rim 18 by the frangible seam 17, whereby when the test cap portion is broken out of the outer end of the overflow cap, the cylindrical rim forms an overflow outlet 19 to the overflow passage 14 through the overflow cap (see FIG. 4).

Protruding outwardly from the test cap portion 16 is a handle 20 which may be grasped by the installer to facilitate threading of the overflow cap 5 into the overflow elbow 3. After the overflow cap is tightly screwed into the overflow elbow and a drain pipe 21 (shown in FIG. 2) and other appropriate connections are made to the sanitary drainage system, the system is ready for pressure testing using air or water.

Figure 5:
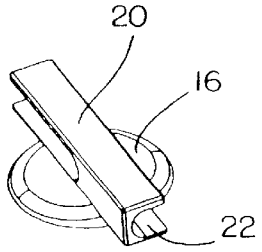
FIG. 5 is a perspective view of the test cap portion after removal from the overflow cap as shown in FIG. 4.

A slot 22 may be provided in the handle 20 for insertion of a screwdriver blade or other rod-like tool (not shown) to facilitate tightening of the overflow cap 5 into the overflow elbow 3 and prying off the test cap portion 16 after the system has been pressure tested to provide the overflow outlet 19 at the outer end of the overflow cap in the manner previously described. The test cap portion 16 with integral handle 20 is shown broken out by itself in FIG. 5.

Figure 3:
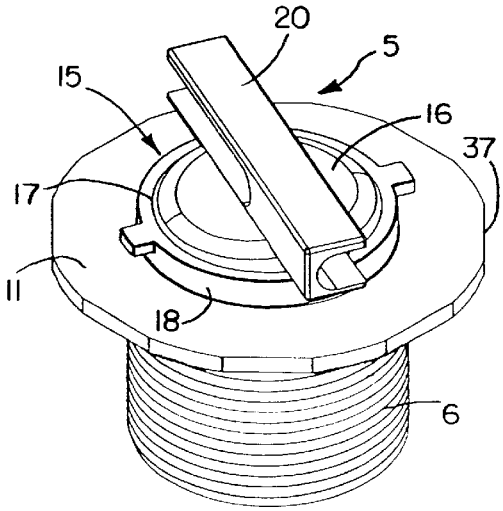
FIG. 3 is an enlarged perspective view of the overflow cap of the waste and overflow system of FIGS. 1 and 2.
Figure 4:
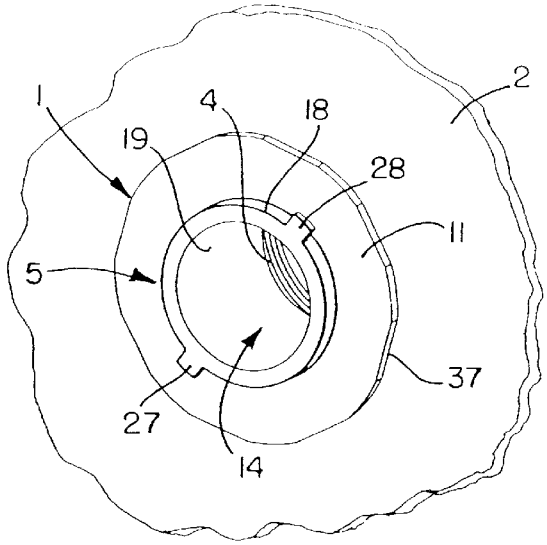
FIG. 4 is a fragmentary perspective view of the waste and overflow system as seen from the left end of FIG. 2 with the test cap portion of the overflow cap removed.
Figure 6:
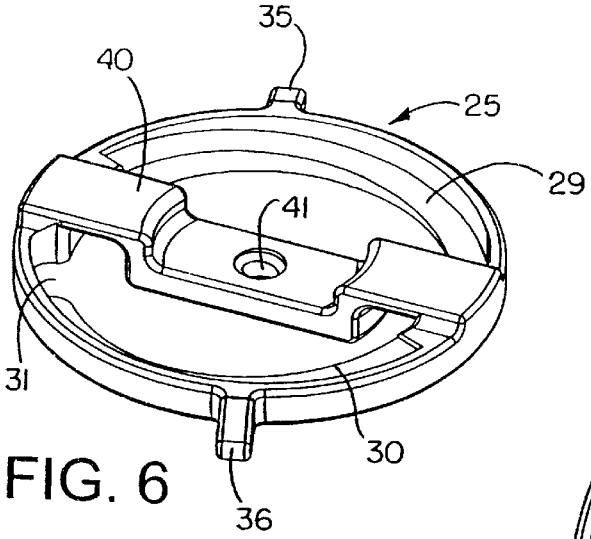
FIG. 6 is an enlarged perspective view of a locking ring that is attached to the overflow cap of FIG. 4 after removal of the test cap portion.
Figure 7:
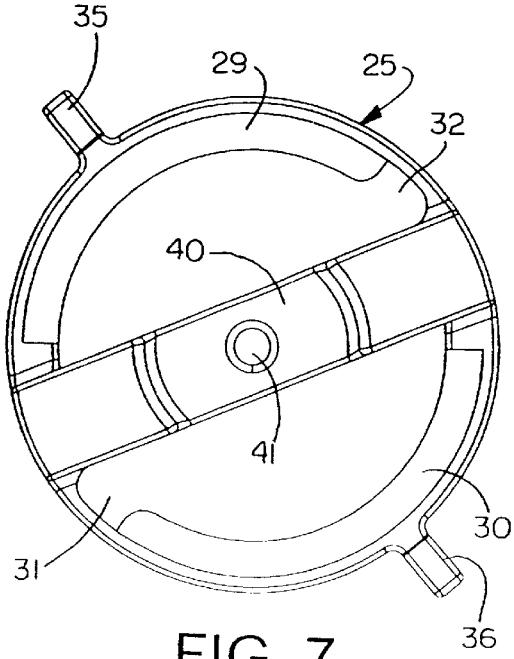
FIG. 7 is a top plan view of the locking ring of FIG. 6.
Figure 8:
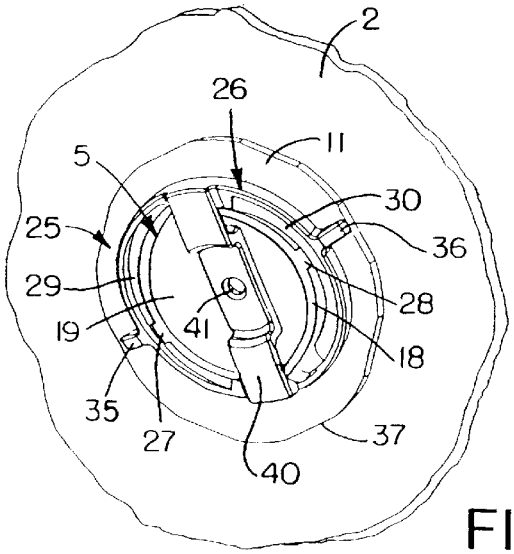
FIG. 8 is a perspective view of the waste and overflow system similar to FIG. 4 but showing the locking ring attached to the overflow cap.

After the test cap portion 16 has been completely broken out of the outer end of the overflow cap 5 as shown in FIG. 4, a locking ring 25, shown in detail in FIGS. 6 and 7, is inserted over the cylindrical rim 18 of the overflow cap and locked in place as shown in FIG. 8. In the invention embodiment disclosed in FIGS. 1–9, a locking connection 26 is provided between the locking ring and overflow cap which includes a pair of locking tabs 27 and 28 on the cylindrical rim 18 of the overflow cap and a pair of locking ramps 29 and 30 on the locking ring, with locking ring openings 31 and 32 adjacent the leading ends of the locking ramps for receipt of the locking tabs. The locking ring 25 is placed around the cylindrical rim 18 of the overflow cap 5 by aligning the two tabs 27 and 28 on the cylindrical rim 18 with the locking ring openings 31 and 32 and rotating the locking ring in a locking direction relative to the overflow cap to ramp the locking ring up tight against the overflow cap flange 11 as shown in FIG. 8. Extending outwardly from opposite sides of the locking ring 25 are finger gripping arms 35 and 36 to facilitate turning the locking ring relative to the overflow cap. Also, the flange portion 11 of the overflow cap 5 may have a non-circular periphery 37 for ease of turning of the overflow cap for unscrewing the overflow cap from the overflow elbow if desired.

Figure 9:
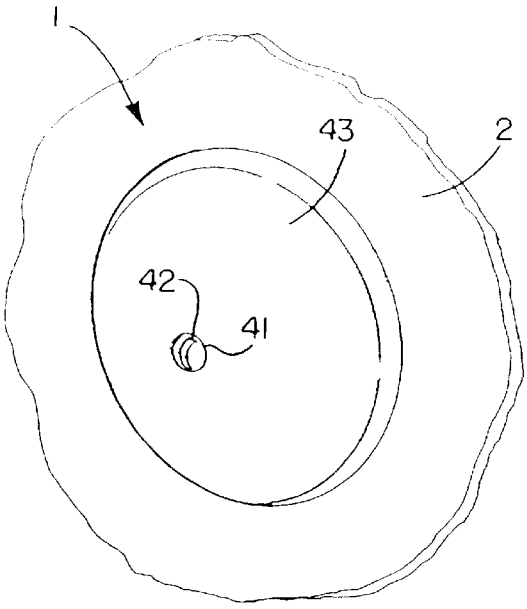
FIG. 9 is a perspective view of the waste and overflow system similar to FIG. 8 but showing a cover plate attached to the locking ring.

The locking ring 25 has a cross member 40 containing a screw hole 41 for receiving a screw 42 used to attach a cover plate 43 over the locking ring and tub overflow outlet 19 as schematically shown in FIG. 9.

Figure 10:
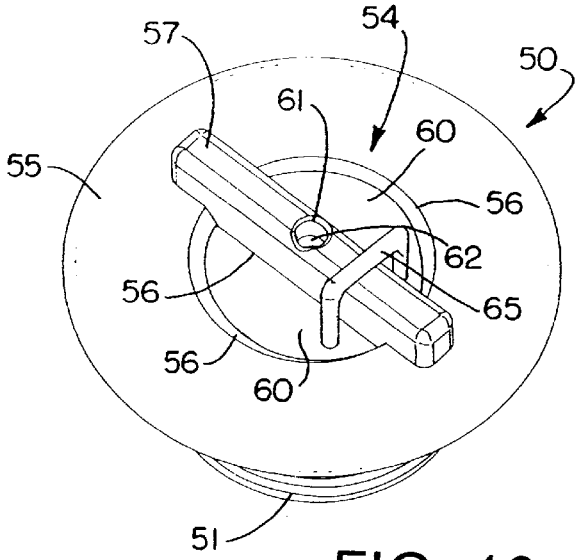
FIG. 10 is an enlarged perspective view of another form of overflow cap in accordance with this invention which may be substituted for the overflow cap of FIGS. 1 and 2.
Figure 11:
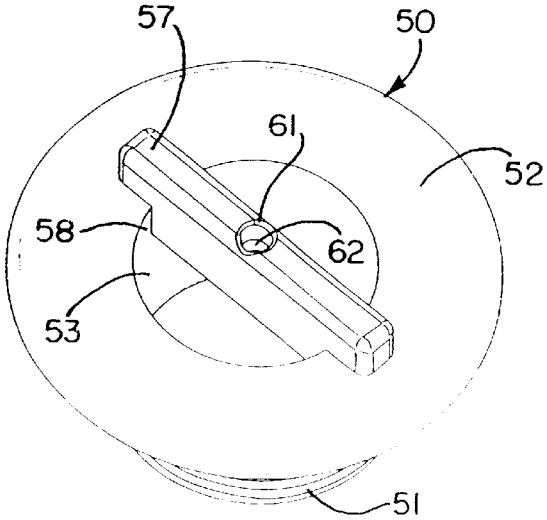
FIG. 11 is a perspective view of the overflow cap of FIG. 10 but with the test cap portion of the overflow cap removed.

FIGS. 10 and 11 show another form of overflow cap 50 in accordance with this invention which may be utilized in place of the overflow cap 5 in the system 1 shown in FIGS. 1 and 2. The overflow cap 50, like the overflow cap 5, has a threaded end portion 51 that is designed to be inserted through the overflow opening 7 in the bathtub 2 and threadedly connected to the overflow elbow or other conduit 3 for securing the overflow elbow against the back side of the tub as before. At the outer end of the overflow cap 50 is a radial flange 52 that engages the front wall of the tub during tightening of the overflow cap into the overflow elbow and an overflow passage 53 (see FIG. 11) extending from one end to the other that is initially closed by a test cap portion 54 that is integrally molded to the outer end 55 of the overflow cap by a frangible seam 56 for ease of removal of the test cap portion after the pressure test has been completed.

A handle 57 is provided at the outer end of the overflow cap 50 for grasping by the installer to facilitate threading of the overflow cap into the overflow elbow 3. However, the handle 57, instead of being integral with the test cap portion as shown in FIGS. 1–3, is permanently affixed to opposite sides of the overflow outlet 58 at the outer end of the overflow cap 50, thus dividing the test cap portion 54 into two frangibly removable test cap portion halves 60. This has the advantage that a blind hole 61 may be provided in the handle 57 for attaching a cover plate 43 to the overflow cap 50 using a screw 42 without the need for a locking ring. Of course, in that event, the hole 61 in the handle 57 can initially only extend part way through the handle so the handle is fluid-tight during pressure testing of the system. However, the end wall 62 of the blind hole 61 can be made thin enough that the screw 42 can punch through the end wall during tightening of the screw within the hole after the pressure test has been completed.

Figure 12:
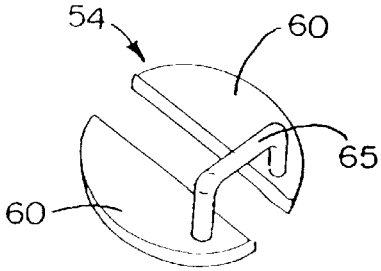
FIG. 12 is a perspective view of the test cap portion after removal from the overflow cap as shown in FIG. 11.

To prevent the test cap portion halves 60 from falling into the overflow outlet 58 during their removal from the outer end of the overflow cap 50, the test cap portion halves are connected together by a tab 65 extending transversely of the handle in axially outwardly spaced relation therefrom (see FIGS. 10 and 12). The test cap portion 54 is shown by itself in FIG. 12 with its two halves 60 connected to opposite ends of the tab 65 after the test cap portion has been broken out of the overflow cap 50.

Figure 13:
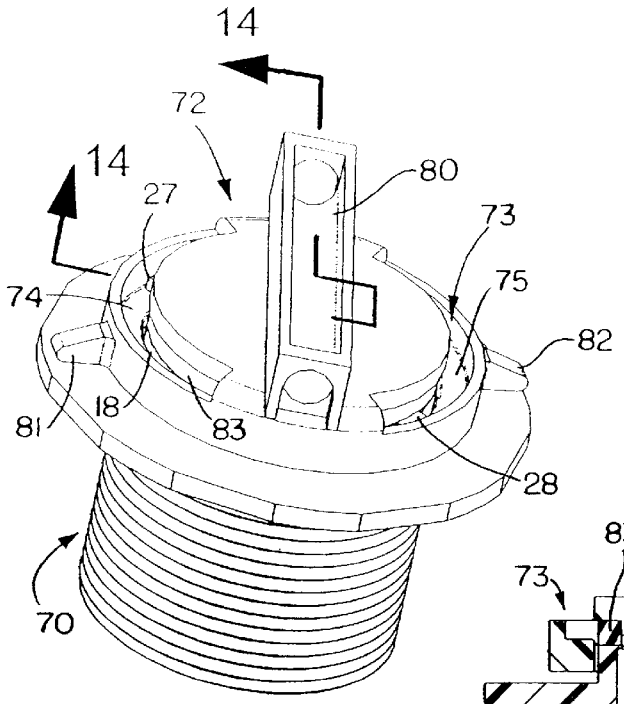
FIG. 13 is an enlarged perspective view of another form of overflow cap in accordance with this invention which includes a mechanical locking connection between the test cap portion and the outer end of the overflow cap.
Figure 14:
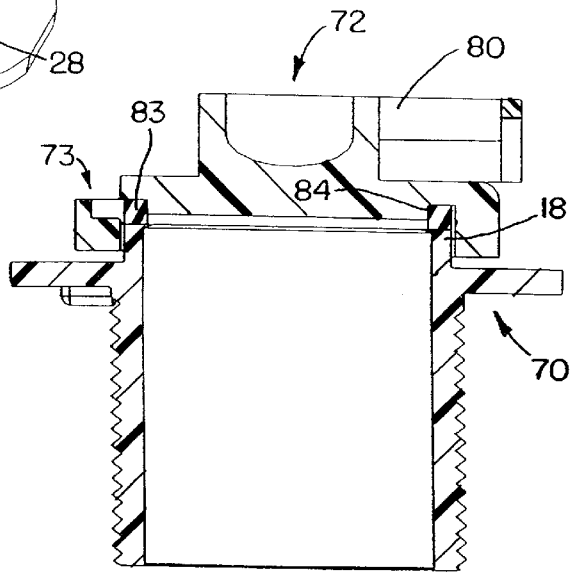
FIG. 14 is a fragmentary transverse section through the overflow cap and test cap portion of FIG. 13 as seen from the plane of the line 14—14 thereof.
Figure 15:
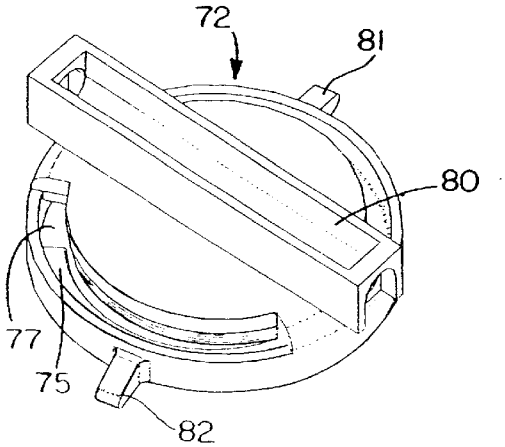
FIG. 15 is a perspective view of the test cap portion of FIGS. 13 and 14 by itself after removal from the overflow cap.
Figure 16:
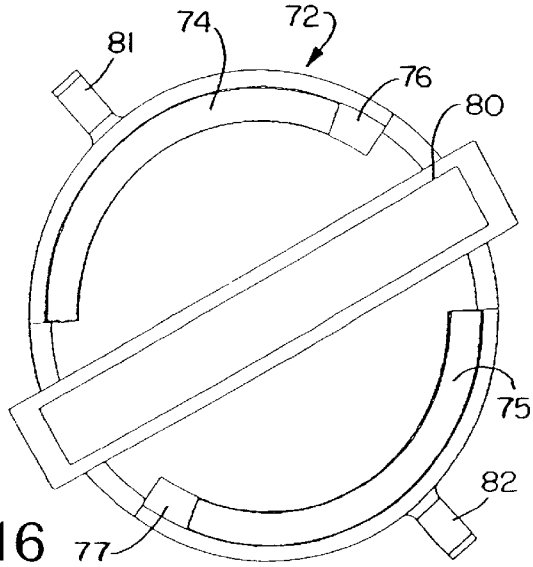
FIG. 16 is an enlarged top plan view of the test cap portion of FIG. 15.

FIGS. 13 and 14 show another form of overflow cap 70 in accordance with this invention which is substantially the same as the overflow cap 5 shown in FIGS. 1–4. However, the overflow cap 70, rather than having a frangible test cap portion as shown in FIGS. 1–4, has a separately formed test cap portion 72, shown by itself in FIGS. 15 and 16, that includes a mechanical locking connection 73 with the overflow cap thus permitting selective attachment and detachment of the test cap portion from the overflow cap. This has the advantage that the test cap portion 72 can be used with more than one overflow cap 70 if desired.

In the embodiment shown in FIGS. 13 and 14, the mechanical locking connection 73 includes a pair of locking tabs 27 and 28 on the cylindrical rim portion 18 of the overflow cap and a pair of locking ramps 74 and 75 on the test cap portion 72, with locking ring openings 76 and 77 adjacent the leading ends of the locking ramps (see FIGS. 15 and 16) for receipt of the locking tabs, similar to the locking connection 26 between the locking ring 25 and overflow cap 5 shown in FIGS. 4–8. The test cap portion 72 is placed around the cylindrical rim 18 of the overflow cap 70 by aligning the two tabs on the cylindrical rim with the test cap openings 76 and 77 and rotating the test cap portion in a locking direction relative to the overflow cap to ramp the test cap portion up tight against the overflow cap.

Protruding outwardly from the test cap portion 72 is a handle 80 which may be grasped by the installer to facilitate turning of the test cap portion relative to the overflow cap. Alternatively, finger gripping arms 81 and 82 may be provided on opposite sides of the test cap portion to facilitate turning of the test cap portion relative to the overflow cap. A gasket 83 is disposed in a groove 84 on the under side of the test cap portion 72 (see FIG. 14) to provide a fluid-tight seal with the upper end of the cylindrical rim 18 of the overflow cap 70 during tightening of the test cap portion on the overflow cap.

After the system is pressure tested and the test cap portion 72 has been removed by rotating the test cap portion in the unlocking direction, a locking ring similar to the locking ring 25, shown in detail in FIGS. 6 and 7, may be inserted over the cylindrical rim 18 of the overflow cap 70 and locked in place as before for securing a cover plate over the locking ring and tub overflow opening using a mounting screw in the manner previously described.

While only one type of mechanical locking connection is shown for selectively mechanically connecting both the test cap portion 72 and the locking ring 25 to the overflow cap 70, it will be appreciated that other types of mechanical locking connections may be utilized, including for example standard type threaded locking connections.

Although the invention has been shown and described with respect to certain embodiments, it is obvious that equivalent alterations and modifications will occur to others skilled in the art upon the reading and understanding of the specification. In particular, with regard to the various functions performed by the above described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function. in the herein illustrated exemplary embodiments of the invention. In addition, while a particular feature of the invention may have been disclosed with respect to only one embodiment, such feature may be combined with one or more other features of other embodiments as may be desired and advantageous for any given or particular application.

What is claimed is:

1. A waste and overflow system for a bathtub comprising an overflow conduit and an overflow cap having opposite ends, one of said ends of said overflow cap being threadedly connectable to an end of said overflow conduit to provide a fluid-tight seal therebetween, an overflow passage extending through said overflow cap from one end to the other, a test cap portion removably connected to the other end of said overflow cap for closing off said overflow passage during pressure testing of the system, said test cap portion being removable from said other end of said overflow cap upon completion of the system pressure test to open up said overflow passage through said overflow cap, said test cap portion being integrally connected to said other end of said overflow cap by a frangible seam for ease of removal of said test cap portion from said overflow cap, and a handle integrally connected to said test cap portion to facilitate tightening of said overflow cap, said handle having a slot for receipt of a rod-like member for use in tightening said overflow cap.

2. A waste and overflow system for a bathtub comprising an overflow conduit and an overflow cap having opposite ends, one of said ends of said overflow cap being threadedly connectable to an end of said overflow conduit to provide a fluid-tight seal therebetween, an overflow passage extending through said overflow cap from one end to the other, a test cap portion removably connected to the other end of said overflow cap for closing off said overflow passage during pressure testing of the system, said test cap portion being removable from said other end of said overflow cap upon completion of the system pressure test to open up said overflow passage through said overflow cap, said test cap portion being integrally connected to said other end of said overflow cap by a frangible seam for ease of removal of said test cap portion from said overflow cap, and a handle integrally connected to said test cap portion to facilitate tightening of said overflow cap, said handle having a slot for receipt of a rod-like member for use in breaking out said test cap portion from said overflow cap.

3. A waste and overflow system for a bathtub comprising an overflow conduit and an overflow cap having opposite ends, one of said ends of said overflow cap being threadedly connectable to an end of said overflow conduit to provide a fluid-tight seal therebetween, an overflow passage extending through said overflow cap from one end to the other, a test cap portion removably connected to the other end of said overflow cap for closing off said overflow passage during pressure testing of the system, said test cap portion being removable from said other end of said overflow cap upon completion of the system pressure test to open up said overflow passage through said overflow cap, said other end of said overflow cap having a cylindrical rim, said test cap portion being integrally connected to said cylindrical rim by a frangible seam for ease of removal of said test cap portion from said other end of said overflow cap, and a locking ring insertable over said cylindrical rim upon removal of said test cap portion, said locking ring and said cylindrical rim having a lockable connection therebetween when rotated in a locking direction relative to one another.

4. The system of claim 3 wherein said lockable connection comprises a pair of locking tabs on said cylindrical ring, and a pair of locking ramps on said locking ring that are overlapped by said locking tabs when said locking ring is rotated in the locking direction relative to said overflow cap to ramp said locking ring up against said overflow cap.

5. The system of claim 4 wherein said locking ring has a cross member containing a screw hole for receiving a screw used to attach a cover plate to said locking ring.

6. The system of claim 5 further comprising tabs extending outwardly from opposite sides of said locking ring for use in turning said locking ring relative to said overflow cap.

7. A waste and overflow system for a bathtub comprising an overflow conduit and an overflow cap having opposite ends, one of said ends of said overflow cap being threadedly connectable to an end of said overflow conduit to provide a fluid-tight seal therebetween, an overflow passage extending through said overflow cap from one end to the other, a test cap portion removably connected to the other end of said overflow cap for closing off said overflow passage during pressure testing of the system, said test cap portion being removable from said other end of said overflow cap upon completion of the system pressure test to open up said overflow passage through said overflow cap, and a handle connected to said test cap portion to facilitate tightening of said overflow cap, said handle having a slot for receipt of a rod-like member for use in applying a force to said test cap portion.

8. A waste and overflow system for a bathtub comprising an overflow conduit and an overflow cap having opposite ends, one of said ends of said overflow cap being threadedly connectable to an end of said overflow conduit to provide a fluid-tight seal therebetween, an overflow passage extending through said overflow cap from one end to the other, a test cap portion removably connected to the other end of said overflow cap for closing off said overflow passage during pressure testing of the system, said test cap portion being removable from said other end of said overflow cap upon completion of the system pressure test to open up said overflow passage through said overflow cap, said other end of said overflow cap having a cylindrical rim, said test cap portion being removably connectable to said cylindrical rim, and a locking ring insertable over said cylindrical rim upon removal of said test cap portion, said locking ring and said cylindrical rim having a lockable connection therebetween when rotated in a locking direction relative to one another.

9. The system of claim 8 wherein said lockable connection comprises a pair of locking tabs on said cylindrical ring, and a pair of locking ramps on said locking ring that are overlapped by said locking tabs when said locking ring is rotated in the locking direction relative to said overflow cap to ramp said locking ring up against said overflow cap.

10. The system of claim 9 wherein said locking ring has a cross member containing a screw hole for receiving a screw used to attach a cover plate to said locking ring.

11. The system of claim 10 further comprising tabs extending outwardly from opposite sides of said locking ring for use in turning said locking ring relative to said overflow cap.

12. The system of claim 10 wherein said other end of said overflow cap has a flange portion surrounding said test cap portion that is engageable with a front side of a bathtub around an overflow opening in the bathtub when said one end of said overflow cap is inserted through the bathtub overflow opening.

13. The system of claim 12 wherein said conduit has a threaded end with an outer diameter greater than the diameter of the bathtub overflow opening.

14. The system of claim 13 wherein said overflow conduit comprises an overflow elbow.

15. The system of claim 12 wherein said flange portion of said overflow cap has a non-circular periphery for ease of turning of said overflow cap for unscrewing said overflow cap from said overflow conduit.

16. The system of claim 8 further comprising a gasket positionable over said one end of said overflow cap, said gasket being compressible upon threading said overflow cap and said overflow conduit together to form a fluid-tight seal between said overflow conduit and a back side of a bathtub.

17. The system of claim 8 wherein said test cap portion is mechanically attachable and detachable from said other end of said overflow cap.

18. The system of claim 8 wherein said test cap portion has another lockable connection with said other end of said overflow cap.

19. The system of claim 8 wherein said another lockable connection comprises a pair of locking tabs on said cylindrical rim at said outer end of said overflow cap, and a pair of locking ramps on said test cap portion that are overlapped by said locking tabs when said test cap portion is rotated in a locking direction relative to said overflow cap to ramp said test cap portion up against said overflow cap.

20. The system of claim 19 wherein said lockable connection between said locking ring and said cylindrical rim comprises said pair of locking tabs on said cylindrical rim, and another pair of locking ramps on said locking ring that are overlapped by said locking tabs when said locking ring is inserted over said cylindrical ring upon removal of said test cap portion and said locking ring is rotated in a locking direction relative to said overflow cap to ramp said locking ring up against said overflow cap.

21. The system of claim 8 wherein said locking ring has a cross member containing a screw hole for receiving a screw used to attach a cover plate to said locking ring.

* * * * *